United States Patent [19]

Hauk

[11] 4,309,238

[45] Jan. 5, 1982

[54] ADJUSTABLE TRACTION WHEEL TENSIONING MECHANISM FOR AN AUTOMATIC WALLBOARD JOINT TAPER

[75] Inventor: Thomas D. Hauk, Los Alamitos, Calif.

[73] Assignee: Hawk Industries, Inc., Signal Hill, Calif.

[21] Appl. No.: 150,892

[22] Filed: May 19, 1980

[51] Int. Cl.[3] ..... B32B 31/00; B44C 7/02

[52] U.S. Cl. ..... 156/575; 156/494; 156/577; 156/578; 156/579

[58] Field of Search ..... 156/523, 524, 526, 527, 156/574, 575, 577, 578, 579, 494

[56] References Cited

U.S. PATENT DOCUMENTS

| | | | |
|---|---|---|---|
| 2,556,443 | 6/1951 | Renne | 156/526 |
| 4,086,121 | 4/1978 | Ames | 156/526 |
| 4,090,914 | 5/1978 | Hauk et al. | 156/523 |

*Primary Examiner*—Michael G. Wityshyn

*Attorney, Agent, or Firm*—Gausewitz, Carr, Rothenberg & Edwards

[57] ABSTRACT

To apply a selectively variable tensioning force to the toothed traction wheels of an automatic wallboard joint taper, and to preclude reverse wheel rotation, an adjustable pawl mechanism is attached to the taper head behind the wheels. The mechanism includes a mounting plate extending transversely between the head assembly side plates, a pawl arm pivoted at one end to a lower portion of the mounting plate, a pawl connected to the plates and positioned behind one of the wheels. A spring connected at one end to a point along the length of the pawl arm, and at its other end to one of a series of apertures in an upper mounting plate lip, exerts a pivotal force on the arm. This biases the pawl into wedging engagement with the wheel and the stop. The biasing force, and thus the tensioning force exerted on the wheel by the pawl, may be selectively varied simply by connecting the tensioning spring between a different point on the pawl arm and a different aperture in the mounting plate lip.

18 Claims, 5 Drawing Figures

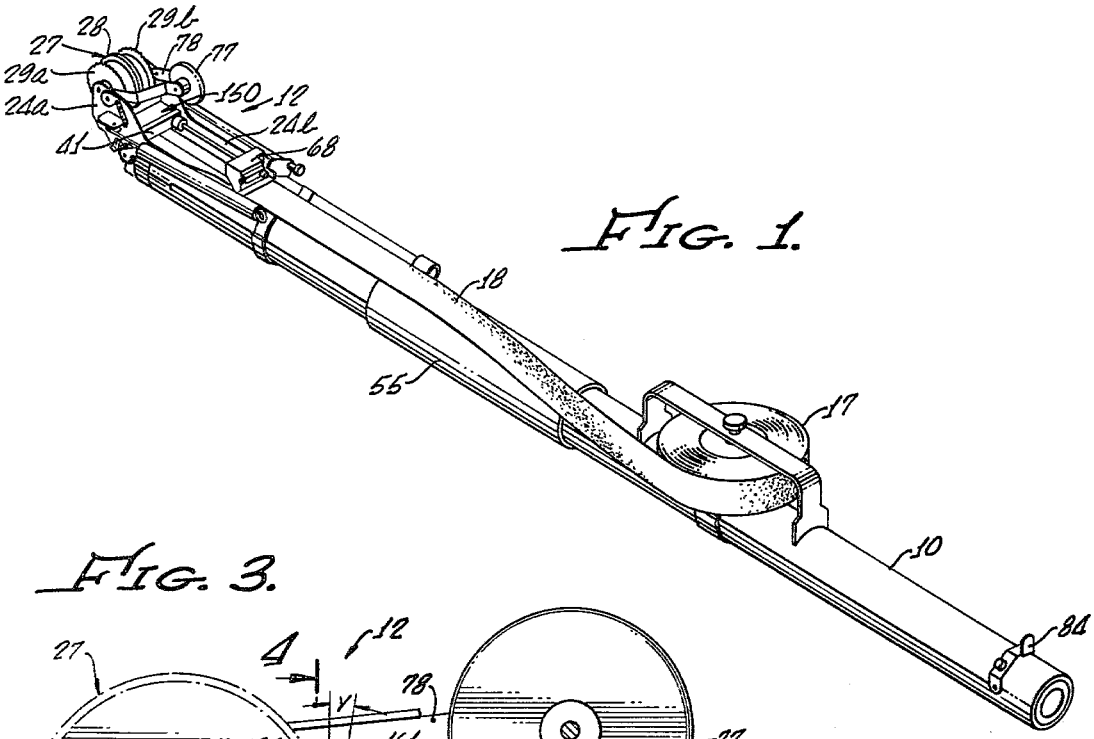
FIG. 1.
FIG. 3.
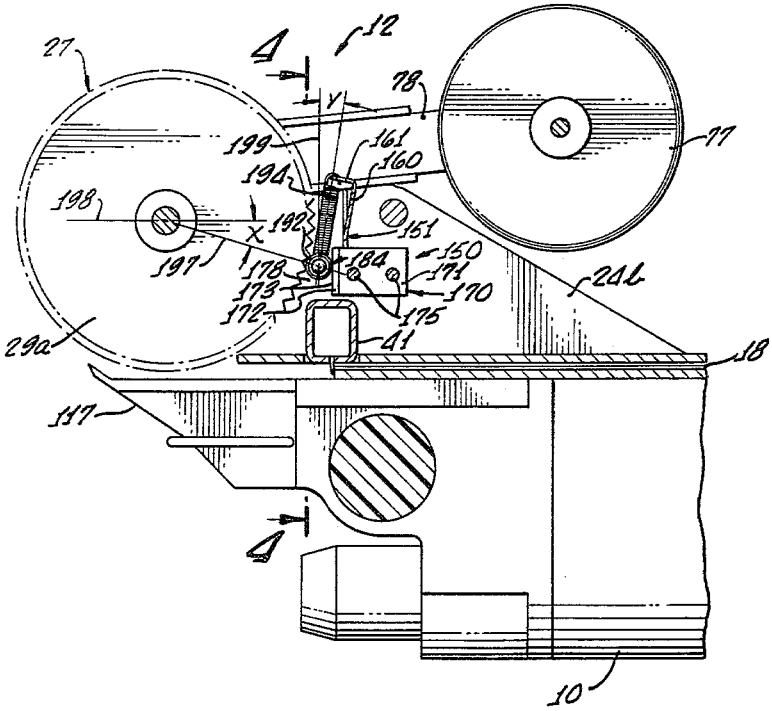
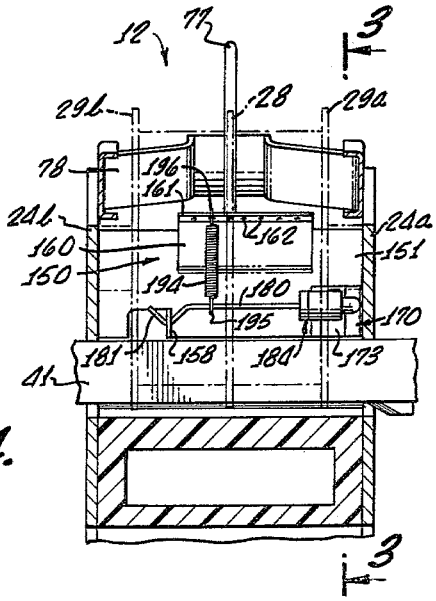
FIG. 4.

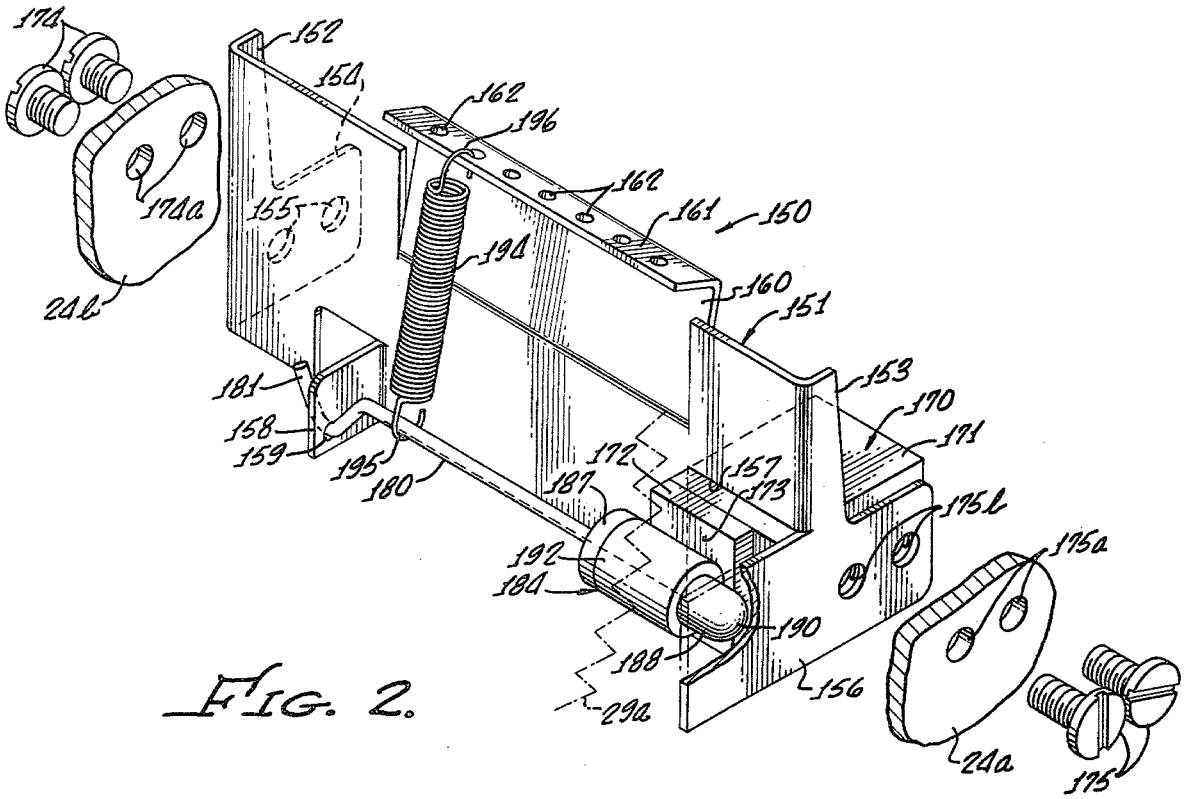
FIG. 2.
FIG. 5.
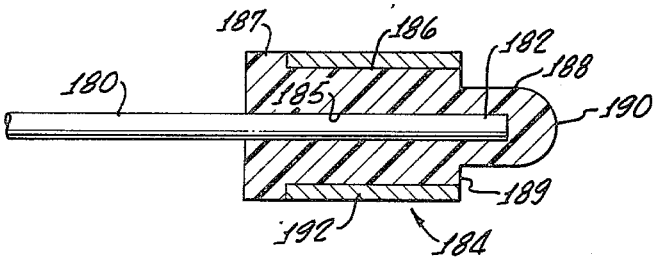

ADJUSTABLE TRACTION WHEEL TENSIONING MECHANISM FOR AN AUTOMATIC WALLBOARD JOINT TAPER

BACKGROUND OF THE INVENTION

1. Field of the Invention

This invention relates to the field of apparatus for applying joint tape and adhesive over the joints between wallboard sections.

2. Description of Prior Art

The Automatic Wallboard Joint Taper shown in Hauk and Konishi U.S. Pat. No. 4,090,914 has proven to be a significant improvement over previous tape and adhesive applicators, due to its time, labor and maintenance-reducing features as well as its smooth and efficient operation. However, a limitation is present in such taper (and other tapers) which, at least potentially, can hinder its normally very efficient and trouble-free operation.

The limitation lies in the nonadjustable ratchet mechanism associated with the taper's toothed traction or drive wheels which engage and roll along the wallboard as the taper is used. This mechanism comprises a generally straight wire spring fixed at one end to a side plate of the taper's head assembly and having a small pawl wedge fixed to its free end. The cantilevered spring is shaped and positioned to bias the wedge into a locking position between the teeth on one of the traction wheels and a knife-guiding tube behind such wheel to preclude rotation of the wheel in one direction. Upon a rotation of the wheel in the opposite (or "operating") direction, the wedge is cammed repetitively by the wheel teeth away from its locking position against the biasing force of the cantilevered spring to which it is attached.. This camming action imposes a constant, though relatively small, "tensioning" force on the rotating traction wheel, slightly restraining its rotation in such operating direction.

It has been found that although the described ratchet mechanism works quite well, many workmen using the taper on a day-to-day basis develop a preference for a greater or smaller tensioning force. To achieve this result, they commonly attempt to bend the straight pawl spring, to increase or decrease its biasing force, by inserting a screwdriver or other tool into the taper head. This may break the spring, requiring installation of a new spring and wedge. Because of the configuration and location of the present ratchet mechanism, such replacement is not an easy task, requiring disassembly of at least a portion of the multi-component taper head, and, thus, a significant amount of down time.

Additionally, these attempts to adjust the nonadjustable frequently render the present ratchet mechanism inoperable, even if the workman manages to only bend the spring with his screwdriver. This is due to the fact that, despite their simple appearance, the pawl wedge and its spring must be manufactured and positioned relative to the drive wheel teeth and knife tube with a relatively great degree of precision to function properly. More specifically, the installed spring must be angled relative to the knife tube in such manner that the spring not only biases the wedge upwardly into engagement with the wheel teeth, but presses the wedge rearwardly against the knife tube as well. Only the most skillful in-field spring bending avoids disturbing this precise angular relationship and rendering the ratchet mechanism inoperative. Of course, such requisite precision also increases the manufacturing, assembly and repair costs of the present ratchet mechanism.

Accordingly, it is an object of this invention to eliminate or minimize above-mentioned and other problems and limitations, while at the same time giving each operator the option to achieve any adjustment he desires.

SUMMARY OF THE INVENTION

The present invention provides a greatly improved pawl mechanism which allows the pawl's tensioning force upon the traction wheels to be rapidly adjusted in the field without potential damage to the mechanism. Importantly, no haphazard bending of precision parts is required to accomplish such tensioning adjustment. Despite the fact that the mechanism is easily adjustable over a wide range of wheel tensioning forces, it is less expensive to manufacture and install than was its nonadjustable predecessor on the Hauk-Konishi taper.

The mechanism includes stop means connected to the taper head assembly in fixed relation relative thereto adjacent the perimeter of one of the toothed traction wheels. Pawl means mounted on an end of an elongated arm engage the stop means and teeth on the wheel perimeter to preclude rotation of the wheel in one direction. The arm is connected to the head assembly at a point on the arm spaced apart from the pawl means. To provide an adjustable tensioning force on the wheel, means external to the arm are provided for exerting a transverse yielding force on the arm at a selectively variable point along its length to thereby exert a selectively variable pivotal force on the arm. Such pivotal force in turn creates a selectively variable yielding contact force between the pawl means and the engaged wheel teeth to adjustably retard wheel rotation in the operating direction.

The arm thus functions as a lever instead of a spring as in the Hauk-Konishi taper pawl assembly. Because of this unique feature, there is no need to even attempt to bend the arm to alter the pawl's wheel tensioning force. Instead, there is effected an adjustment of the external force-exerting means to change the point along the arm at which the transverse force is exerted.

In a preferred embodiment of the present invention, the force-exerting means comprise a specially designed mounting plate and an ordinary helical spring having hooked ends. The mounting plate is connected to the taper head assembly and extends between its side plates behind the traction wheels. The end of the arm opposite the pawl means is pivotally mounted to a forwardly projecting lower portion of the mounting plate, the arm extending transversely of the traction wheels. In an upper portion of the mounting plate is formed a series of apertures, the series extending parallel to the arm. One of the spring ends is received in one of the plate apertures, and the other spring end is hooked around the arm. To change the wheel tensioning force the spring is repositioned along the arm by connecting the spring to another of the plate apertures.

According to a feature of the invention, the pawl means comprises a generally cylindrical pawl member rotatably mounted on the arm, and the stop means comprises a stop member having an essentially planar front surface. The force-exerting means bias the pawl member into wedging engagement with the wheel perimeter and the front stop member surface, with a side portion of the pawl member contacting the stop member surface. As the pawl-engaged traction wheel is rotated in its operating direction, it rotates the pawl member to evenly distribute wear on the pawl member's outer surface.

According to another feature of the invention, the force-exerting means are positioned so that the transverse force exerted on the arm has a component directed transversely toward the planar stop member surface to keep the cylindrical pawl member in engagement with the stop member during wheel rotation in the operating direction. Such force component prevents undesired separation of the pawl member from the wheel during wheel rotation in the operating direction.

BRIEF DESCRIPTION OF THE DRAWINGS

FIG. 1 is a perspective view of an automatic wallboard joint taper to which is attached an adjustable traction wheel tensioning mechanism embodying principles of the present invention;

FIG. 2 is a greatly enlarged, partially exploded perspective view of the wheel tensioning mechanism and portions of the taper head assembly;

FIG. 3 is a cross-sectional view through a forward portion of the head assembly taken along line 3—3 of FIG. 4;

FIG. 4 is a cross-sectional view through a forward portion of the head assembly taken along line 4—4 of FIG. 3; and FIG. 5 is a greatly enlarged longitudinal cross-sectional view taken through the pawl member of the tensioning mechanism and an end portion of the arm on which the pawl member is rotatably mounted.

DETAILED DESCRIPTION

Except for the adjustable traction wheel tensioning mechanism specified below, the present joint-taping tool illustrated in FIG. 1 is substantially identical to the one disclosed in U.S. Pat. No. 4,090,914, issued May 23, 1978, for an apparatus for applying tape and adhesive to wallboard joints. The specification and drawings of said patent are hereby incorporated by reference herein. For convenience, the reference numbers for the unchanged portions of the tool disclosed by said patent (hereinafter referred to as the "original" tool) are also used in the present application. Before describing the novel wheel tensioning mechanism, however, the general structure and operation of the modified tool of FIG. 1 will be briefly described.

Like the original tool, the modified one depicted in FIG. 1 includes an elongated hollow aluminum barrel 10 having an "outer" end (to the right in FIG. 1) and an inner or "forward" end (to the left in FIG. 1). The barrel functions both as an adhesive reservoir and a handle for the tool, and has secured to its forward end a head assembly 12 which faces the wallboard as the tool is being used.

The head assembly 12 includes a pair of parallel side plates, **24*a* and 24*b*, positioned on generally opposite sides of the barrel and projecting forwardly and upwardly from its forward end. Rotatably mounted between forward portions of the side plates is a roller 27 having a central flange 28 and a pair of toothed traction wheels, 29*a* and 29*b***, fixed to its opposite ends and spaced inwardly of the side plates.

Spaced inwardly from the outer end of the barrel is a roll 17 of standard wallboard joint tape 18 which is rotatably mounted on the barrel. From the roll 17, the tape extends along the barrel toward the head assembly 12 and passes sequentially under a tape feed block 68, a knife-guiding tube 41 and then exits the head assembly between the roller 27 and an adhesive discharge nozzle 117 (FIG. 3) positioned beneath the roller 27.

To use the tool, the operator grasps the barrel and positions the traction wheels against the wallboard on opposite sides of the joint to be taped. The free end of the tape is positioned between the central roller flange 28 and the wallboard, and the tool is moved downwardly along the joint which causes the traction wheels to rotate in a clockwise (or "operating" direction) as viewed in FIG. 3.

As illustrated and more fully described in U.S. Pat. No. 4,090,914, the roller 27 is linked, through a torque-limiting mechanism and a drum and cable assembly, to a piston within the barrel in such manner that this rotation of the roller 27 in the operating direction causes the piston to advance toward the forward end of the barrel. The advacement of the piston forces adhesive out the discharge nozzle and onto the underside of the tape as the tape is pulled from its roll and applied along the wallboard joint by the rotating roller.

At the end of each taping stroke, the tape is severed from the tool by moving a slidably mounted sleeve 55 rearwardly along the barrel 10. The rearward movement of the sleeve 55 draws a cutting blade (within the knife tube 41) transversely across the tape by means of a spring-loaded cable or chain mechanism connected to the sleeve 55. To start a new taping stroke, the sleeve 55 is pushed toward the head assembly 12, which causes the tape-feeding block 68 to advance in the same direction. A pin on the block moves the tape forward a short distance so that it can be placed under the central roller flange 28 to begin a new taping stroke.

For corner joint-taping applications, a corner wheel 77 is rotatably mounted on a bracket 78 which is pivotally connected to the side plates. Through a spring-loaded cable and pulley arrangement, the bracket 78 is linked to a lever 84 which is pivotally mounted on the barrel adjacent its outer end. When it is desired to apply the tape to a corner joint, the lever 84 is pivoted in a counterclockwise direction as viewed in FIG. 1. This causes the bracket to also pivot in a counterclockwise direction to position the corner wheel against the corner joint as the tool is moved along it, tucking the tape neatly into the corner.

In the original tool, a nonadjustable pawl mechanism is provided which prevents reverse rotation of the traction wheels (i.e., in a counterclockwise direction as viewed in FIG. 3), and additionally exerts a constant "tensioning" force on them, retarding their rotation in the operating direction. Such wheel tensioning force dictates the force required to move the tool along the joint, and thus the "feel" of the tool during its use.

As illustrated in the above-mentioned patent, the original tensioning mechanism comprises a cantilevered wire spring arm fixed at one end to one of the side plates and having mounted on its free end a pawl wedge which is positioned between the knife-guiding tube and the perimeter of the traction wheel adjacent the opposite side plate. To obtain a proper pawl-biasing and positioning force from the nonadjustable spring arm, a substantial degree of precision is required in the manufacture of the arm and in positioning it in the proper angular relationship relative to the knife tube. Despite such precision and its attendant expense, as a practical matter only one tensioning force upon the traction wheels can be achieved with a given installed spring arm.

In an attempt to increase or decrease the wheel tensioning in the original tool, many operators using the tool have attempted to bend the spring arm to alter the contact force between the pawl wedge and the wheel teeth, and thus the feed of the tool. Very often this simply ruins the tensioning mechanism—either breaking the rather delicate spring arm or inalterably changing the necessary shape and/or position of the arm.

The present invention provides an adjustable pawl mechanism which allows the wheel tensioning force to be varied quickly and easily without potential damage to the mechanism. As will be seen, this much needed improvement is achieved with simple components which may be manufactured and installed on the taper with much less precision than the original mechanism. Because of this, the new mechanism, despite its adjustability, is less expensive to produce and install than its predecessor.

THE ADJUSTABLE TRACTION WHEEL TENSIONING MECHANISM

Referring first to FIG. 2, the adjustable wheel tensioning mechanism 150 includes a specially designed mounting member or metal mounting plate 151 which is connected to and extends transversely between the side plates 24*a*, 24*b* (FIGS. 3 and 4), in a generally vertical plane, behind the traction wheels 29*a*, 29*b*. The mounting plate 151 not only supports and positions other components of the mechanism, but functions itself as a part of the means for adjusting the tensioning force on the traction wheels.

The mounting plate 151 is generally of an elongated rectangular shape and has narrow end edge portions 152, 153 bent rearwardly to engage the inner surfaces of the side plates. A mounting tab 154, having apertures 155 formed therein, extends rearwardly from a lower end portion of the left edge portion 152. A second tab, 156, extends forwardly and rearwardly from a lower end portion of the right edge portion 153. Adjacent the tab 156, a notch 157 is formed in the plate, the notch extending upwardly from the lower plate edge. Spaced slightly inwardly from the left tab 154 is a third tab, 158, having an aperture 159, which projects forwardly, in a vertical plane, from a bottom portion of the plate.

A fourth tab, 160, extends upwardly of the plate along a central upper edge portion thereof, and is bent rearwardly through a small angle relative to the plate. An outer end portion of the central upper tab 160 is bent forwardly to form a transverse lip 161. Formed through the lip 161 is a series of apertures 162, the series extending parallel to the longitudinal extent of the mounting plate. As will be seen, the central apertured tab 160 plays an important role in allowing the traction wheel tensioning mechanism to be rapidly and easily adjusted.

Extending forwardly through the plate notch 157 is a stop member 170 comprising an elongated brass block 171 having a relatively thin Carborundum wear plate 172 fixed to its front end. The front surface 173 of the wear plate 172 is essentially planar, parallel to the mounting plate, and positioned slightly rearwardly of the outer end of the tab 156.

The mounting plate 151 and the stop member 170 are secured to the side plates 24*a*, 24*b* by suitable fasteners 174, 175. Fasteners 174 extend inwardly through openings 174*a* formed in the side plate 24*b*, and are received in the apertures 155 in the tab 154. The fasteners 175 extend inwardly through openings 175*a* formed in the side plate 24*a* and are received in suitable apertures 175*b* formed in the block 171 and through the rearwardly projecting portion of the tab 156. Tightening of the fasteners 175 draws the stop member 170 against the tab 156 to secure the right end of the mounting plate against the inner surface of the side plate 24*a*.

As can be seen in FIGS. 3 and 4, the installed mounting plate extends transversely between the side plates 24*a*, 24*b* and is positioned directly behind the traction wheels 29*a*, 29*b*, above the knife-guiding tube 41. The forwardly projecting plate tab 158 is positioned inwardly adjacent the traction wheel 29*b* and is positioned below its axis. The stop member 170 is positioned directly behind the traction wheel 29*a* and is spaced downwardly of its axis, the front wear plate surface being transverse to the traction wheel 29*a* and facing its perimeter. The front surface of the wear plate and the perimeter of the traction wheel 29*a* define a gap 178 (FIG. 3) between the wheel and the stop member whose width progressively decreases from the bottom to the top of the wear plate front surface.

Referring again to FIG. 2, an elongated, generally straight wire lever arm 180 has a hooked end portion 181 which is received in a tab aperture 159, thus mounting the arm 180 on the mounting plate 151 for pivotal motion parallel to the mounting plate about an axis transverse to the arm 180.

From its end pivot point at the plate tab 158, the arm 180 extends toward the traction wheel 29*a* and is oriented generally transversely thereto, the free end 182 of the arm extending through the gap 178 between the stop member 170 and the perimeter of the traction wheel 29*a*.

Rotatably mounted on the free end 182 of the arm 180 is a generally cylindrical pawl member 184 (FIG. 5), the free arm end 182 being rotatably received in an opening 185 extending longitudinally through the pawl member. As best seen in FIG. 5, the pawl member 184 comprises a cylindrical plastic inner portion 186 having a radially outwardly extending perimetral flange 187 at its inner end, and a reduced diameter portion 188 projecting axially outwardly from its outer end 189. The reduced end portion 188 has a rounded outer end 190 which cooperates with the right end plate tab 156 in a manner described below to retain the rotatably mounted pawl member 184 on the arm 180.

A metal collar 192 is press-fitted on the cylindrical inner pawl portion 186 for rotation therewith, and extends along its length, one end of the collar abutting the flange 187 and the other collar end being flush with the outer end 189 of the inner portion 186. As depicted in FIG. 3, the metal collar 192 has an outer diameter smaller than the lower width of the gap 178, but larger than the upper gap width. By means described below, the collar is biased upwardly into the gap into wedging engagement (along the side surfaces of the metal collar) with teeth on the traction wheel 29*a* and the front surface 173 of the wear plate 172. In this position, the collar precludes rotation of the traction wheel 29*a*, and thus the opposite traction wheel 29*b*, in a counterclockwise direction as viewed in FIG. 3. An attempted counterclockwise wheel rotation presses the pawl member 184 against the wear plate 172, while at the same time exerting an upward force on the pawl member. Because the diameter of the collar 192 is greater than the upper gap width, the pawl member is prevented from moving above its normal or "wedged" position indicated in FIG. 3.

However, clockwise rotation of the traction wheel 29a, as viewed in FIG. 3, is permitted by the pawl member 184. Such clockwise rotation (i.e., wheel rotation in the operating direction) cams the pawl member downwardly as viewed in FIG. 3, despite the presence of a biasing spring force described below. The biasing force also provides an adjustable tensioning force upon the wheel 29a.

To bias the pawl member toward its normal position, and to permit rapid adjustment of the pawl's tensioning force on the traction wheel 29a, a small helical tension spring 194 (FIG. 2), having hooked ends 195, 196, is interconnected between the lever arm 180 and the transverse tab 161, the spring extending transversely of the arm. The spring end 195 is hooked around the arm 180, thereby permitting movement of the spring end 195 along the arm, and the spring end 196 is inserted in one of the lip apertures 162, as best illustrated in FIGS. 2 and 4.

The spring 192, in its interconnected position indicated in FIG. 4, exerts a yielding counterclockwise pivotal force on the lever arm 180 which urges the pawl member 184 upwardly into wedging engagement with teeth on the perimeter of the traction wheel 29a and the front stop member surface 173 as best illustrated in FIG. 3. This pivotal biasing force creates a yielding contact force between the pawl member and the wheel teeth which retards rotation of the traction wheel 29a in its operating direction. The magnitude of such contact force, and thus the magnitude of the tensioning or "drag" force on the traction wheels, is directly proportional to the pivotal force exerted on the arm by the spring. The pivotal force, in turn, is directly proportional to the distance between the axis of the spring and the arm pivot point at the mounting plate tab 158.

Thus, to selectively vary the wheel tensioning force the position of the spring axis relative to the lever arm is shifted. This may be rapidly and easily accomplished by hooking the upper spring end 196 into another of the tab lip apertures 162 (to the right for a higher tensioning force, and to the left for a lower one) and moving the lower spring end 195 along the arm until it is below the new aperture. Importantly, no bending of delicate parts is required and the tensioning adjustment in no way even potentially harms the adjustable mechanism.

Because the pawl biasing and tensioning force is accomplished by means external to the arm 180 (the arm being now used as a lever instead of a spring), the shape and positioning of the arm is much less critical than were the shape and positioning of the nonadjustable spring arm in the above-mentioned patent. Surprisingly and unexpectedly, this allows the fully adjustable tensioning mechanism, despite its additional components, to be manufactured and installed at less cost than its nonadjustable predecessor.

The pawl member 184 is cylindrical in shape and is rotatably mounted on the lever arm 180. As the traction wheels are rotated in their operating direction, and the pawl member is cammed downwardly, the pawl member is rotated (in a counterclockwise direction as viewed in FIG. 3) by the traction wheel 29a. This distributes wear on the pawl member evenly around the perimeter of the metal collar 192. Moreover, wear on such collar is also distributed axially along its perimeter. This is due to the fact that the pawl member is permitted to slide back and forth (i.e., to the left and right in FIG. 5) along the free end 182 of the arm to at least a small extent. The pawl member is precluded from dislodgement from the free end of the arm by the end portion 188 whose rounded outer end 190 contacts the inner surface of the mounting plate tab 156 when the pawl member is at its outermost position. The cylindrical shape of the pawl member, coupled with its rotatable and slidable mounting on the arm, considerably extends the life of the pawl member which, like other components of the taper, is subjected to the high abrasiveness of the adhesive used in the taping process.

As previously mentioned, the lever arm 180 (and thus the pawl member 184) is positioned below the axis of the traction wheels. It has been found that for the smoothest and most reliable operation of the described mechanism, a reference line 197 (FIG. 3) extending through the axis of the traction wheel 29a and through the axis of the pawl member 184 should form an acute angle x of approximately 20° with a reference line 198 extending horizontally through such wheel axis. Additionally, it is preferable that the axis of the spring 192 be angled rearwardly of a reference line 199 extending vertically through the pawl member axis through an acute angle y of approximately 10°. Such angling of the spring (which is automatically effected by the rearwardly angled plate tab 160) causes a component of its force upon the pawl member to be directed transversely toward the stop member front surface 173. This holds the pawl member against the stop member and prevents undesired separation of the pawl member from the stop member during camming of the pawl member by the traction wheel 29a as it is rotated in its operating direction.

The foregoing detailed description is to be clearly understood as given by way of illustration and example only, the spirit and scope of this invention being limited solely by the appended claims.

I claim:

1. In combination with an automatic wallboard joint taper of the type having a pair of toothed traction wheels mounted for conjoint rotation on a head assembly connected to a handle adapted to contain a quantity of adhesive, and means for feeding a length of joint tape past the head assembly, depositing adhesive on the tape, and applying the tape and its adhesive along a wallboard joint in response to a movement of the head assembly along the joint causing rotation of the traction wheels in an operating direction, apparatus for precluding rotation of the wheels in the opposite direction and for applying a selectively variable rotational retarding force upon the wheels to restrain their rotation in the operating direction, said apparatus comprising:

(a) stop means mounted on the head assembly in fixed relation relative thereto, said stop means being adjacent and spaced radially outwardly from the perimeter of one of the traction wheels;

(b) pawl means, interposed between and engaging said stop means and said perimeter of said one of the traction wheels, for precluding rotation of said one of the traction wheels in said opposite direction and for imposing a variable rotational retarding force on said one of the driving wheels, upon a rotation thereof in said operating direction, in response to a variable yielding force exerted upon said pawl means; and (c) means for exerting said variable yielding force upon said pawl means, said force-exerting means comprising:

(1) an elongated arm connected at one end to said pawl means, (2) means connecting said arm to the head assembly and engaging said arm at a point thereon spaced apart from said one end thereof, and (3) means for exerting a transverse yielding force upon said arm at a selectively variable point along its length.

2. The apparatus of claim 1 wherein said force-exerting means (c) (3) includes a spring and means for interconnecting said spring between said arm and the head assembly at a selectively variable location relative to the length of said arm.

3. The apparatus of claim 2 wherein said spring has first and second opposite hooked end portions, and wherein said interconnecting means comprise said hooked end portions and a mounting member secured to the head assembly, said mounting member having formed therein a series of apertures, said series extending generally parallel to said arm, said first hooked end portion circumscribing said arm, and said second hooked end portion being received in one of said apertures, whereby the position of said spring may be varied to alter said yielding force upon said pawl means by connecting said second hooked end portion to another of said apertures and moving said first hooked end portion along said arm.

4. The apparatus of claim 3 wherein said connecting means (c) (2) includes means for pivotally connecting an opposite end portion of said arm to said mounting member.

5. The apparatus of claim 1 wherein said connecting means (c) (2) includes means for pivotally connecting an opposite end of said arm to the head assembly, and wherein said force-exerting means (c) (3) pivotally biases said arm toward a normal position in which said pawl means wedgingly engages said stop means and said perimeter of said one of the traction wheels.

6. The apparatus of claim 5 wherein said stop means comprises a stop member having a substantially planar front surface facing said perimeter of said one of the traction wheels, and wherein said pawl means comprises a generally cylindrical pawl member extending longitudinally between said wheel perimeter and said front surface of said stop member, said pawl member engaging said front surface along an outer side surface of said pawl member.

7. The apparatus of claim 6 wherein said pawl member is rotatably mounted on said arm, whereby rotation of said one of the traction wheels in said operating direction causes a rotation of said pawl member to thereby distribute wear on said pawl member evenly around its perimeter.

8. The apparatus of claim 1 wherein said stop means comprises a stop member having a front surface portion facing said perimeter of said one of the traction wheels and engaged by said pawl means, and wherein said transverse yielding force of said force-exerting means (c) (3) has a component directed toward said front surface portion.

9. The apparatus of claim 8 wherein said front surface of said stop member is substantially planar, and wherein said transverse yielding force is angled relative to the plane of said front surface.

10. Apparatus for applying a selectively variable tensioning force to a toothed traction wheel rotatably mounted on the head assembly of an automatic wallboard joint taper, said apparatus comprising:

(a) an elongated arm;

(b) means for pivotally connecting an end portion of said arm to the head assembly;

(c) pawl means, connected to the free end of said arm, for engaging teeth on the traction wheel and restraining rotation of the wheel to a degree proportional to the magnitude of a yielding contact force between said pawl means and said teeth;

(d) means for exerting a selecitvely variable yielding pivotal force on said arm to urge said pawl means into engagement with said teeth with a yielding contact force of selectively variable magnitude, said pivotal force means including:

a spring and means interconnecting said spring between said arm and the head assembly in a first position in which said spring extends generally transversely from a first point along the length of said arm, and permitting movement of said spring to a second position in which said spring extends generally transversely from a second point along the length of said arm; and (e) means for precluding undesired separation of said pawl means from said teeth.

11. The apparatus of claim 10 wherein said interconnecting means includes a mounting member secured to the head assembly and having a series of apertures formed therein, each of said apertures being adapted to receive an end portion of said spring, said series extending generally parallel to said arm.

12. The apparatus of claim 11 wherein said connecting means (b) includes a portion of said mounting member, and wherein said arm extends substantially transversely of the traction wheel.

13. The apparatus of claim 10 wherein said arm extends substantially transversely of the traction wheel, and said pawl means comprises a generally cylindrical pawl member mounted on said free end of said arm and engaging said wheel teeth along a side surface of said pawl member.

14. The apparatus of claim 13 wherein said pawl member is rotatably mounted on said free end of said arm, said separation-precluding means includes a stop member secured to the head assembly and having a substantially planar front surface portion spaced apart from and facing said teeth, and said pivotal force means (d) urges said pawl member into wedging engagement with said teeth and said front surface portion of said stop member.

15. The apparatus of claim 14 wherein said pawl member is slidably and rotatably mounted on said free end of said arm, and said pawl member has outer end means for engaging a portion of said mounting member to preclude undesired separation of said pawl member from said arm.

16. For use with an automatic wallboard joint taper of the type having a pair of toothed traction wheels mounted for conjoint rotation of an upper forward portion of a head assembly between a pair of mutually spaced, vertically extending parallel side plates of the head assembly, the axes of the wheels being transverse to the side plates, and means for moving a length of tape past the head assembly, depositing adhesive on the tape, and applying the tape and its adhesive along a wallboard joint in response to a movement of the head assembly along the joint causing rotation of the traction wheels in an operating direction, a mechanism for precluding wheel rotation in the reverse direction and for applying a selectively variable tensioning force to the wheels to retard their rotation in the operating direction, said mechanism comprising:

(a) a mounting member secured to the head assembly and extending between the side plates rearwardly of the traction wheels, said mounting member having a forwardly projecting lower portion, and an upper portion in which is formed a series of apertures, said series extending generally transversely of the traction wheels;

(b) a stop member secured to the head assembly, said stop member having a substantially planar and vertical front surface portion extending generally transversely of one of the traction wheels, said front surface portion being spaced rearwardly of, positioned below the axis of, and facing the perimeter of said one of the traction wheels;

(c) an elongated arm pivoted at one end to said lower portion of said mounting member, said arm extending substantially transversely of said one of the traction wheels and having a free end adjacent said stop member;

(d) a pawl member mounted on said free end of said arm; and (e) a spring extending substantially transversely of said arm and having a first end movably connected to said arm at a point along its length, and a second end received in one of said apertures in said mounting member, said spring exerting a pivotal force on said arm biasing said pawl member upwardly toward a normal position in which said pawl member is in wedging engagement with said front surface portion of said stop member and teeth on said wheel perimeter, and creating a yielding contact force between said pawl member and said teeth, said pawl precluding rotation of said one of the traction wheels in said reverse direction, and retarding rotation thereof in said operating direction to a degree proportional to the magnitude of said contact force, said contact force being selectively variable by inserting said second spring end in another of said apertures and moving said first spring end to a different point along the length of said arm.

17. The mechanism of claim 16 wherein said pawl member is of a generally cylindrical shape, is rotatably mounted on said free end of said arm, and engages said teeth and said front surface portion of said stop member along side surfaces of said pawl member.

18. The mechanism of claim 17 wherein said mounting member comprises a mounting plate extending transversely of the side plates and positioned in a substantially vertical plane, and said upper portion of said mounting plate comprises a rearwardly angled upper portion having a forwardly bent outer lip in which said series of apertures is formed, whereby the axis of said spring is angled relative to the plane of said front surface portion of said stop member and the force of said spring transmitted to said pawl member has a component directed perpendicularly toward said front surface portion of said stop member, thereby to keep said pawl member in engagement with said stop member during rotation of said one of the traction wheels in said operating direction.

* * * * *